United States Patent [19]

Slagle

[11] Patent Number: 4,540,179

[45] Date of Patent: Sep. 10, 1985

[54] TRAINING METHOD FOR PUTTING GOLF BALLS

[76] Inventor: Frederick A. Slagle, 7050 Griswold Rd., Madison, Ohio 44057

[21] Appl. No.: 545,941

[22] Filed: Oct. 31, 1983

[51] Int. Cl.[3] ..... A63B 69/36

[52] U.S. Cl. ..... 273/186 C; 273/192; 273/187 A

[58] Field of Search ..... 273/192, 186 C, 167 A, 273/167 B, 187 A, 187 R, 186 A, 186 R, 32 R, 35 R

[56] References Cited

U.S. PATENT DOCUMENTS

| | | | |
|---|---|---|---|
| 3,572,720 | 3/1971 | Berg | 273/186 C X |
| 4,153,255 | 5/1979 | Woodson | 273/186 C X |
| 4,322,084 | 3/1982 | Reece et al. | 273/186 C X |

*Primary Examiner*—George J. Marlo

*Attorney, Agent, or Firm*—Watts, Hoffmann, Fisher & Heinke Co.

[57] ABSTRACT

Golf training system and method for improving ones skills in putting a golf ball including providing a golf putter having a putter face, placing said putter face in right angle alignment to a golf ball disposed on a putting surface, aligning the hands, shoulders and head generally at right angles to the line of intended movement of the golf ball, positioning a spinner member having an inclined ramp-like surface adjacent the rear of the ball and generally at right angles to the intended line of movement of said golf ball, striking the golf ball with a predetermined, short, and low putting stroke so as to move the putter face up and over the ramp-like surface of the spinner member for striking the ball with the putter face and with an upward stroke as the putter face approaches and reaches the contact zone so as to impart a top-spin to the golf ball such that the golf ball moves with over-spin in a clockwise direction toward the putting hole.

4 Claims, 6 Drawing Figures

TRAINING METHOD FOR PUTTING GOLF BALLS

DESCRIPTION

1. Technical Field

A golf training system and more particularly a novel training system and method for teaching and/or improving ones skills in putting a golf ball on a putting surface, such as on what is known as a putting green. The system of the invention includes three basic components for utilizing the training method including an aligner device, T-bar device, spinner device, and roller device that are utilized in conjunction with a new and novel reel-type putter which together are synergistically utilized for aids in repeatedly stroking the golf ball in a manner to optimize ones putting skills.

2. Related Patent Applications

The present application for a training system and method for putting a golf ball relates to applicants copending U.S. patent application Ser. No. 527,951 filed Sept. 1, 1983. Such prior pending application relates specifically to the function and structure of the novel reel-type putter which may be utilized in practicing the method of the present invention, and which application is incorporated herein by reference.

3. Background Art

As pointed out in applicants aforementioned copending application, with the substantial rise in the popularity of the game of golf, it has been recognized that one of the most important aspects of the golf game, if not the most important, relates simply to the ability to putt the golf ball into the hole with the least number of strokes. Though conceptually simple, this is one of the most difficult skills to master and for the great majority of people takes the longest time to perfect, if one can say that such skill has, in fact, ever been perfected. To recognize the difficulties relative to acquiring and/or maintaining this skill, one need only observe the many types of new golf putters which enter the market each year and also the many and varied putting techniques utilized by the professional golfers, all in an effort to reduce the number of putts per round of golf. Accordingly, it is believed that the basic difficulty in acquiring putting proficiency resides not so much, if at all, in the type or style of putter but rather with perfection of a putting stroke which will strike and propel the golf ball in a manner such that the ball, in effect, pulls itself into the hole. In the present invention, it has been found that this result can be achieved with accuracy and with repeatablity by system and method to perfect a putting stroke that insures that the golf ball will be struck in a manner to impart top-spin to the ball. This top-spin gives to the ball a rotational momentum that, in effect, enables the ball to pull itself directly into the hole. Hence, having then placed in motion, this rotational momentum accelerates the ball in a clockwise direction rather than in a counter-clockwise direction to provide a rotational friction as opposed to a sliding friction thereby giving the ball a tracking action that controls its rolling motion in a straight-line direction toward the hole.

For reference to prior putting devices and/or methods utilizing various ball bearing or roller type arrangements, reference may be had, for example, to U.S. Pat. Nos. 2,255,332; 2,300,043; 2,426,274; and 3,680,868.

DISCLOSURE OF THE INVENTION

In accordance with the present invention there is provided a training system and method for use in improving ones skills in putting a golf ball that enables the golfer to consistently utilize what is considered herein to be the most perfect putting stroke. This stroke incorporated a relatively short, in-line, take-away which parallels the putting surface and that enables the golfer to then strike through the ball in the same stroke path so as to move the ball with an upward stroke of the putter face as it approaches and reaches the ball contact zone. The object of this upward stroke being to impart a top-spin or over-spin to the ball. In the aforementioned, result of its top-spin on the ball is to provide a more consistently true line of direction, speed, and control.

BEST MODE FOR CARRYING OUT THE INVENTION

Figure 1:
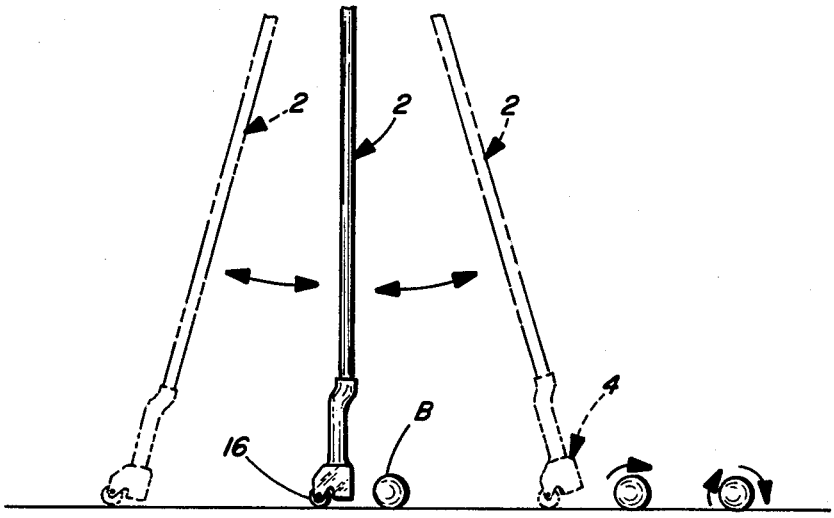
FIG. 1 is a generally diagramatical illustration showing the putting stroke of the invention wherein the reel of the putter is always maintained in contact with the putting surface.

As disclosed in the applicants co-pending application Ser. No. 527,951, in carrying out the method of the present invention, the training putter device, as illustrated in FIG. 1, is placed on the putting surface and, applying a slight downward pressure, it is then moved back and forth till the golfer has a "feel" for the stroke pattern. During this time, it is emphasized to not lift the putter head from the putting surface. Maintaining the putter head on the putting surface throughout the stroke insures that the golfer will program a short take-away with acceleration through the contact zone. This exercise is repeated until the golfer becomes comfortable with the new feeling of keeping the putter head down. Then the ball may be placed down and the exercise is repeated while rolling the training device through the contact zone. Again, the golfer is reminded not to lift the putter head. By applying downward pressure, the training device automatically does the job. This exercise is now repeated with the ball till the golfer develops a programmed short, low, straight take-away with acceleration through the ball. Now in accordance with the present method and system, it will be seen hereinafter that this perfect putting stroke can be mastered with practice but with less time and effort as compared to prior training techniques.

Figure 2:
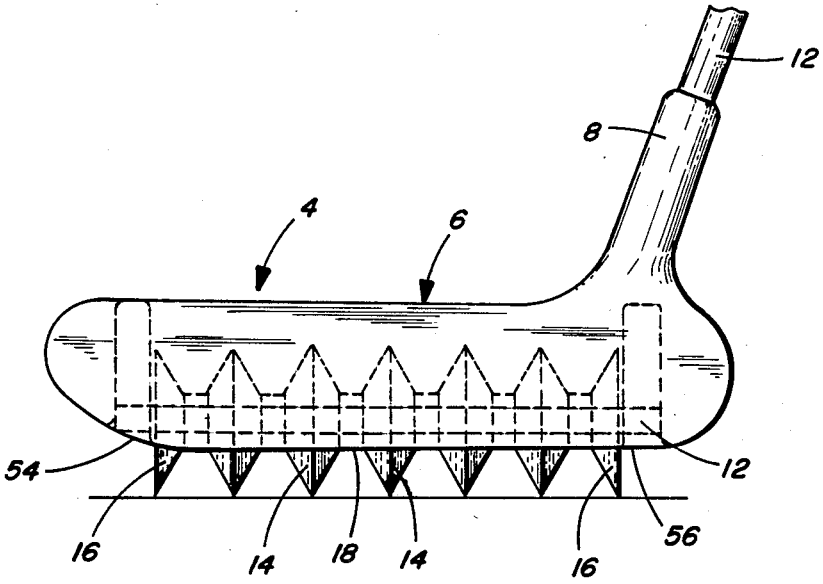
FIG. 2 is a fragmentary, side elevation view, on an enlarged scale of the novel reel type putter which may be utilized in conjunction with the system and method of the present invention.

In FIGS. 1 and 2 it is illustrated a golf putter, designated generally at 2, which incorporates the novel reel-type putter head, designated generally at 4, for striking a golf ball B. In FIG. 2 the putter 4 includes a standard shaped putter body 6 including a hossel 8 to which is connected a handle 12. The putter body 6 includes an elongated axle 12 which is mounted for rotation in the putter body and may carry a series of axially spaced, disc-like reel elements 14 separated by annular grooves 18. The end disc elements 16 may be formed of half-sections, as disclosed in applicants aformentioned copending application Ser. No. 527,951.

Figure 3:
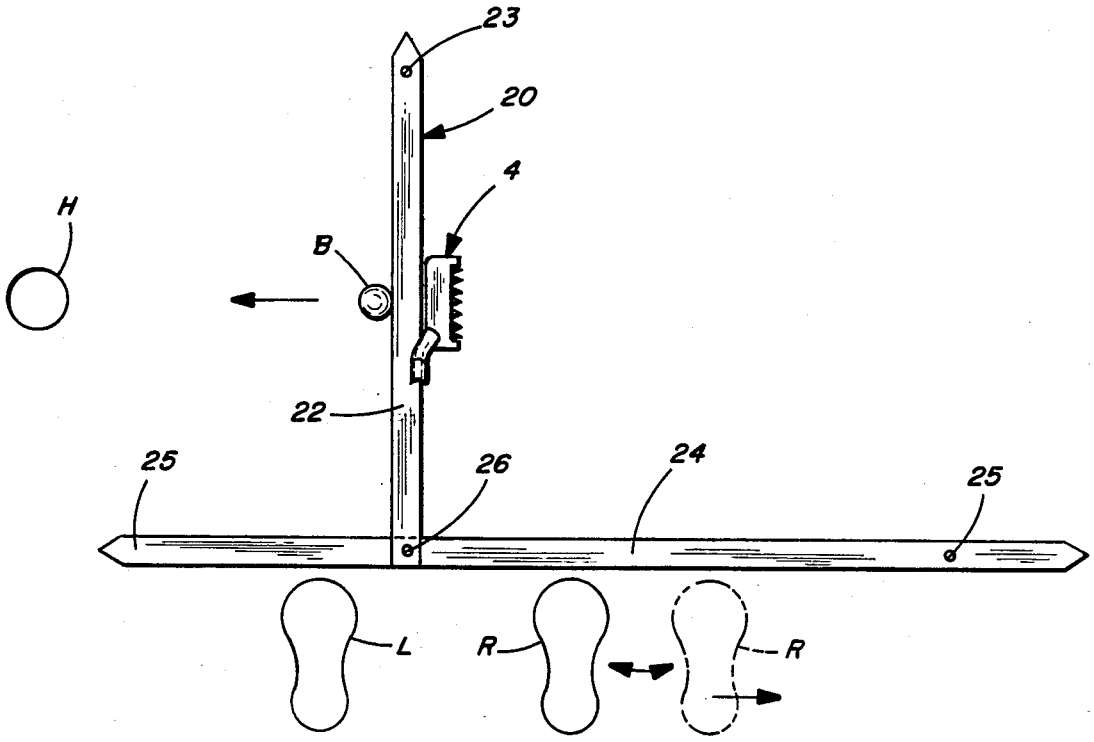
FIG. 3 is a top plan view illustrating utilization of the T-bar device in accordance with the present invention.

Referring to FIG. 3, the aligner device, designated generally at 20, includes an elongated, generally flat body member 22 which may be made of a plastic material or the like. The body member has a hole at one end 23 adapted to receive a fastener, such as a nail, pin, or the like for securing the same to the putting surface. The other end has another hole, 26, which may receive a similar type fastener for attaching the body member 22 to another elongated, flat body member 24 which together provide a T-bar configuration. Similarly, the body member 24 may be provided with holes, as at 25, at the opposite ends for receiving fasteners for securement of the T-bar to the putting surface. It will be seen that the body member 22 is to be disposed normal to or perpendicular to the body member 24 to provide a consistent positioning of the feet (left and right) in a square stance that places the ball B (FIG. 3) in line with the inside of the left foot. Accordingly, it is preferred that the left foot L always remains in the same position, whereas, the right foot R is located in a comfortable stance which can be remembered for repeated positioning. As is seen, therefore, that the putter head 4 is maintained parallel to the body member 22 and hence, at right angles to the body member 24 so that it also always remains in line with the ball B. The square positioning of the feet then acts to provide a base from which the golfer can assume and direct in-line positioning of the hip, shoulders and head in respect to the ball.

Figure 4:
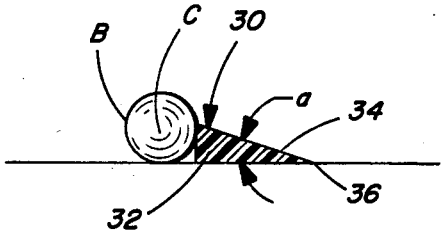
FIG. 4 is a side elevation view illustrating the spinner device of the present invention.
Figure 5:
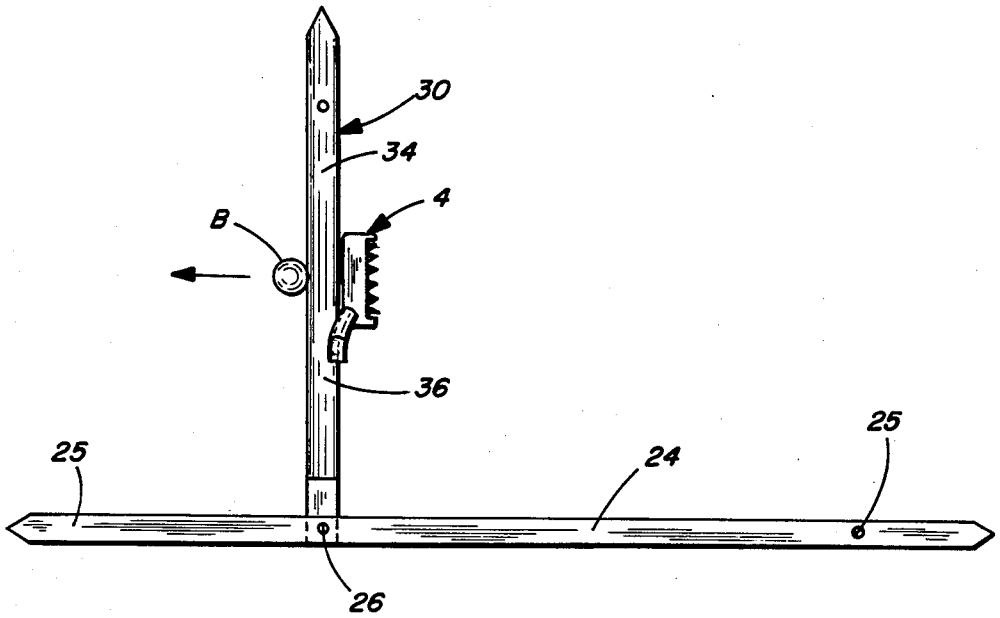
FIG. 5 is a top plan view illustrating the spinner device of FIG. 4 utilized in conjunction with the T-bar device in accordance with the system and method of the present invention.
Figure 7:
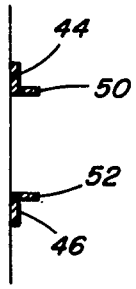

As seen in FIGS. 4 and 5, the spinner device, designated generally at 30, is utilized to enable the golfer to strike the golf ball B toward the hole H at or slightly above the geometric center C. The spinner device 30 is detachably mounted to the member 24 via the hole 26 by means of a nail, pin or the like or may be used separately therefrom. As illustrated in FIG. 4, the spinner device 30 includes an elongated ramp member 32 which has a right-triangular (in transverse cross-section) configuration having an inclined ramp surface 34 terminating in an apex edge 36 which preferrably has an angle of inclination of approximately 18°. Preferrably, this angular orientation is between 10° and 30°, as defined by the included angle (a).

As illustrated in FIG. 5, the ramp member 32 may be detachably mounted on the T-bar member 22 such that the putter head 4 is disposed parallel to the apex edge 36 so as to putt the ball B in a straight-line toward the hole H.

Figure 6:
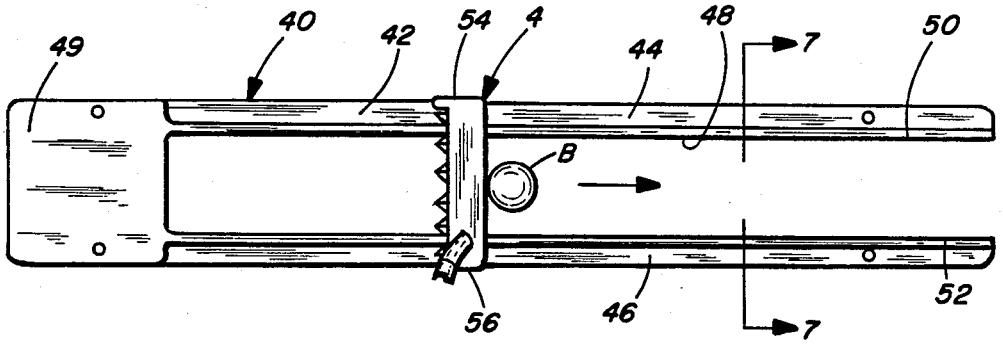
FIG. 6 is a top plan view of the roller device made in accordance with the invention.

In FIG. 6 there is illustrated a further component of the training system including a stroke-trainer member, designated generally at 40, which includes a generally U-shaped body member 42 defined by a pair of integral outwardly extending parallel legs 44 and 46 which together define an elongated slot 48 therebetween and which extend from a unitary head portion 49. The slot 48 has a widthwise dimension greater than that of the ball B so that the ball may be placed therein and struck by the putter head 4. The reel assembly of the putter head 4 rides upon the confronting rib surfaces 50 and 52 of the legs 44 and 46 which act as guide members such that the putter head can ride, as at 54 and 56, thereon be taken away in a straight-line and returned through the impact zone in the same general vertical plane.

In the typical application, the putter 2 is placed on the putting surface, and by applying a slight downward pressure, it may be moved back and forth until the golfer feels the stroke pattern, as illustrated in the dotted line in FIG. 1. In this case, it is important not to lift the putter from the putting surface. Keeping the putter applied to the surface throughout the stroke insures that the golfer will program a short take-away with acceleration through the contact zone, as illustrated in FIG. 1. This exercise is repeated until the golfer becomes comfortable with the new feeling of keeping the putter down. The golfer may then place the ball down and repeat the same exercise while rolling the putter via the reel mechanism through the contact zone.

The aligner device 20 and T-bar 24 device are then located square to the hole H. The ball is then placed in relation to the putter face, as illustrated in FIG. 3. With the ball placed in front of the aligner device 20, the golfer may then position his feet at a comfortable distance providing that the feet are disposed generally normal to or at right angles to the T-bar member 20. With the shoulders remaining normal in respect to the alignment of the feet, the golfer is then reminded to maintain his head perfectly still, whereas, he is then ready to "roll" the putter. After a good number of putts have been made (i.e., 50 or more) the golfer may next putt with his own personal putter. The ball is then struck from the same position using the programmed short, low, straight take-away with acceleration through the ball. If satisfactory results are achieved from this distance, the aforementioned sequence is repeated each time from one foot of additional length. It is recommended that the efforts be concentrated within a distance from 12 feet or closer.

The next step to be programmed via the system is the act of imparting "top-spin" directly from the putter face. It has been found that an immediately rolling ball reacts in a more true direction than a ball that is pushed, punched, or pinched from the putter face. In the present invention, after the golfer has perfected the "soft act" of imparting top-spin, he will notice the balls actually diving into the hole rather than rimming it. Accordingly, the aligner device is replaced with the spinner device 30 (FIG. 5) such that the feet are against and aligned properly again as the case with the aligner device. Again, using the training putter device 2 and commencing at from 3 to 4 feet from the hole, the golfer experiences the feel of the putter rising as it contacts the inclined ramp-like edge 36 of the spinner device 30. This then acts to, in effect, cam the putter head 4 as it reaches the contact zone. At this point, the golfer will also experience an increased head speed coupled with a more positive direction of the ball. Again, after making an ample number of putts (i.e., 50 or more) in succession, the golfer then uses his personal putter. The ball B is placed in front of the spinner device 30 and the programmed stroke is repeated. Upon striking the apex 36 edge of the spinner device 30 before making contact with the ball it is insured that the head of the putter 4 is kept low. However, with practice the stroke is gradually programmed so as to automatically rise at impact thereby developing a perfect over-spin and control.

Referring again to FIG. 6, there is illustrated a roller device 40 which provides a guide track to enable a golfer to perfect the programmed short, low, straight take-away with acceleration through the ball. As noted, this includes a generally flat body member of generally U-configuration defined by a pair of unitary outwardly extending leg portions 42 and 44. The leg portions extend parallel to one another and define an elongated slot 48 therebetween for receiving the golf ball B therein. The legs each include an integral upstanding rib 50 and 52 portions which coact with the confronting journalled ends 54 and 55 (FIG. 2) of the putter head such that the putter can be easily rolled via the reel assembly on the ribs to strike the ball with the programmed stroke. Here again, this device may be provided with any type of fastening means for securing the same to the putting surface. In use, the device can be positioned at right angles to the aligner device 20 and parallel to T-bar member 24 for properly lining the feet, shoulders, head, and then the ball with the hole, as foresaid.

In summary, the method for teaching the present invention includes the basic concepts of maintaining the putter low, taking a short, in-line backstroke, accelerating the putter head through the ball contact zone, maintaining eye concentration on a spot in front of the ball, maintaining the head still, and to not look up, wait and listen for the ball to drop into the hole. Importantly, the user should pick a spot about one inch in front of the ball and fix his eyes on the spot and disregard the ball itself. In the invention, the novel reel-type putter, unlike a conventional putter, acts to relay the message for the perfect putting stroke through the hands such that the user will immediately know that he has pulled or pushed without looking at the path of the ball. Accordingly, it is important to program, by practice, the back and return strokes and via the sight in front of the ball before the user proceeds to the next step of imparting top spin directly from the putter face.

Another aspect of the invention is that one can use an identical or twin putter but without the reel mechanism so as to have the identical feel and mental image for duplicating the putting stroke. Further, in the invention it is significant that while practicing with the aligner device or spinner device, that one can utilize a blindfold and have another person align the putter and the ball in their respective positions. Then one makes the putting stroke without the benefit of vision. This exercise greatly reduces eye (head) movement thereby greatly increasing the distance feeling and true sensitivity in the grip. This blind-user exercise acts to build extreme confidence in the golfer and particularly after he has become accustomed to this exercise.

Further advantages and objects of the present invention will become apparent as the following description is taken in conjunction with the appended claims.

I claim:

1. A training method for teaching and/or improving the user's skills in putting a golf ball on a putting surface, the steps including providing a golf putter having a putter face, placing a golf ball on the putting surface, placing a spinner member having an inclined ramp-like surface on the putting surface, positioning said golf ball in front of said spinner member with said inclined ramp-like surface extending downwardly and rearwardly away from said golf ball, addressing said golf ball by placing said putter face immediately adjacent the rear of said golf ball on the opposite side of said spinner member and taking said putter face in a back-swing by a smooth, low putting stroke away from said golf ball, reversing said putting stroke and moving said putter face downwardly with a low putting stroke so as to move the putter face into contact with said spinner member and up and over said inclined ramp-like surface for striking said golf ball by said putter face with an upwardly moving stroke of said putter face as it approaches and reaches contact with said golf ball so as to impart a top-spin to the golf ball such that the ball moves with over-spin in a counterclockwise direction toward the putting hole.

2. A training method in accordance with claim 1, including aligning the user's feet and shoulders in general parallel alignment with the intended line of movement of said golf ball, and maintaining the head of the user still and generally at right angles to said intended path of movement of said golf ball.

3. A training method in accordance with claim 2, wherein a generally T-shaped alignment member is placed on said putting surface having one portion disposed parallel to the user's feet and another portion detachably connected to said first portion and extending generally at right angles with respect to said first mentioned portion to align the user's feet and the user's shoulders in a square relationship relative to said golf ball.

4. A training method in accordance with claim 3, including using a first putter member having a roller member fixedly attached thereto for rolling said putter face toward and away from said golf ball, and a second conventional type putter member without said roller member for striking said golf ball after the performance of practice putting strokes with said first mentioned roller putter member.

* * * * *